US007637491B2

(12) United States Patent
Hiura

(10) Patent No.: US 7,637,491 B2
(45) Date of Patent: Dec. 29, 2009

(54) SHEET STACKING DEVICE, SHEET FEEDING DEVICE, AND IMAGE FORMING APPARATUS

(75) Inventor: Hiroshi Hiura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 11/475,654

(22) Filed: Jun. 27, 2006

(65) Prior Publication Data

US 2007/0001372 A1 Jan. 4, 2007

(30) Foreign Application Priority Data

Jun. 30, 2005 (JP) ..... 2005-191537

(51) Int. Cl.
*B65H 3/14* (2006.01)

(52) U.S. Cl. ..... 271/97; 271/98

(58) Field of Classification Search ..... 271/5, 271/11, 97, 112
See application file for complete search history.

(56) References Cited

U.S. PATENT DOCUMENTS 5,523,858 A * 6/1996 Yamada et al. ..... 358/412
6,015,144 A 1/2000 Yoshii et al.
7,140,605 B2 * 11/2006 Suga et al. ..... 271/97
7,140,606 B2 * 11/2006 Suga et al. ..... 271/97
2003/0057633 A1 3/2003 Okazaki et al.
2004/0178557 A1 * 9/2004 Okazaki et al. ..... 271/97
2006/0175746 A1 * 8/2006 Adachi ..... 271/97
2006/0180984 A1 * 8/2006 Suga et al. ..... 271/97

FOREIGN PATENT DOCUMENTS

JP 2003-063675 A 3/2003
JP 2003-165641 A 6/2003
JP 2004-284783 A 10/2004
JP 2005-096993 A 4/2005

* cited by examiner

*Primary Examiner*—Kaitlin S Joerger
(74) *Attorney, Agent, or Firm*—Canon USA Inc IP Div

(57) ABSTRACT

A sheet cassette including a sheet stacking case configured to contain sheets, the sheet stacking case having a securing mechanism for securing an air supply unit supplying air, and a duct for sending the air supplied from the air supply unit to end portions of the contained sheets, thereby allowing the air supply unit to be attached to blow the air only when necessary.

8 Claims, 10 Drawing Sheets

SHEET STACKING DEVICE, SHEET FEEDING DEVICE, AND IMAGE FORMING APPARATUS

BACKGROUND OF THE INVENTION

1. Field of the Invention

The present invention relates to a sheet stacking device containing sheets (recording media) to be supplied to an image forming apparatus, and a sheet feeding device and an image forming apparatus each provided with the sheet stacking device. More particularly, the present invention relates to a configuration for separating sheets tightly contacting each other for feeding.

2. Description of the Related Art

A conventional image forming apparatus (e.g., a copier, printer or the like) is provided with a sheet feeding device with which sheets contained in a sheet stacking device (e.g., a sheet cassette, sheet feeding deck or the like) are sequentially fed from the top of the stack of the sheets by a feed roller and separated by a sheet separating portion one by one to be fed to an image forming portion.

In such a sheet feeding device, cut sheets are used for continuous feed of the sheets. Such cut sheets are often limited to quality paper or plain paper designated by a copier manufacturer.

A variety of sheet separating systems have conventionally been employed to reliably separate sheets one by one for feeding. One such sheet separating system is a separating pad system in which a friction member contacts with a feed roller at a prescribed pressure, for example, so as to prevent double feed of the sheets disposed therebetween.

Another sheet separating system is a retard roller separating system having a pickup roller for sending out the sheets, a feed roller rotating in a sheet conveying direction, and a separating roller driven at a prescribed torque in a direction opposite to the sheet conveying direction and contacting with the feed roller at a prescribed pressure. With this sheet separating system, if a plurality of sheets are sent out by the pickup roller, only the top sheet is allowed to pass through the feed roller and the separating roller, while the sheet beneath the top sheet sent out together is returned to thereby prevent double feed of the sheets.

In order to ensure separate feeding of sheets in these systems, in the case of the separating pad system, for example, the friction force (between the feed roller and the sheet, between the sheets, and between the sheet and the separating pad) and the pressing force (feed roller contact pressure, separating pad contact pressure) are taken into consideration and optimized to surely separate the sheets one by one.

Meanwhile, with diversification of the sheets (recording media) in recent years, there is an increasing demand for image formation, not only on extra thick paper, OHP sheet, art film and others, but also on coated sheets having the surface coated to achieve higher degree of whiteness or gloss in response to the needs of the market for colorization.

In feeding the extra thick paper, however, its own weight may become conveyance resistant, making it difficult to pick up the sheet and thereby cause jamming. Further, in the case of the sheets made of a resin material that tends to be charged, such as the OHP sheet or the art film, when the sheet feeding operation proceeds in low-humidity environments, the sheet surfaces may gradually be charged as the sheets are rubbed with each other, in which case the sheets would tightly contact each other by the Coulomb force, leading to failure in picking up the sheet or occurrence of double feed.

Further, in the case of the coated paper having the sheet surface applied with a coating material such as paint, the sheets tend to stick together particularly when they are stacked in high-humidity environments, which again may lead to failure in picking up the sheet or occurrence of double feed.

Such problem occurs for the following reasons. In the case of the special sheets as described above, although the friction force between the sheets in itself may be equivalent to or less than in the case of the plain paper or the like, a sticking force caused by frictional electrification in low-humidity environments in the case of the resin material sheets or a sticking force generated in high-humidity environments in the case of the coated sheets, would lead to the sticking force between the sheets being much stronger than the friction force therebetween. Thus, the sheets cannot be separated reliably with conventional sheet separating systems.

That is, in the case of the conventional sheet separating systems, the friction force between the sheets alone is taken into consideration. Thus, it would not be possible to surely separate the sheets from each other when the sticking force is applied in addition to the friction force.

In order to cancel such very strong sticking force between the sheets, a sheet separating system for reliably separating the sheets one by one by fanning the sheets in advance by blasting the air onto the side face of the sheet stack to cancel the sticking between the sheets, and then picking up the sheets sequentially from the top of the sheet stack and reliably separating them one by one at a separating portion provided downstream, as disclosed in Japanese Patent Laid-Open No. 11-005643 (corresponding to U.S. Pat. No. 6,015,144), is employed in the print industry and in some copiers.

In the sheet separating system provided with such an air blasting mechanism blasting air onto the side face of the sheet stack, even in the case of the sheets (recording media) highly sticky as described above, the sheets are fanned prior to the feeding to cancel the sticking, so that the separating performance is improved as compared to the above-described systems utilizing only the friction force.

A sheet feeding device provided with such an air blasting mechanism will now be described with reference to FIGS. 9 and 10. FIG. 9 is a cross sectional view of an image forming apparatus, and FIG. 10 is a top plan view of a sheet feeding device 55. The sheet feeding device 55 is arranged beneath an image forming portion (including an image writing unit 31, an image bearing member 35, a charging unit 37, a developing unit 39, a transfer roller 43, and a fixing unit 45) of an image forming apparatus 21. The sheet fed from the sheet feeding device 55 is discharged to a discharge tray 49 after an image is formed thereon at the image forming portion.

As shown in FIG. 9, sheet feeding device 55 includes a sheet cassette 59 for containing sheets S thereon, and a sheet feeding portion 60 for feeding sheets S from sheet cassette 59. Further, as shown in FIG. 10, an end guide 65 is provided on the opposite side of sheet cassette 59 from sheet feeding portion 60 (on the rear end side of the sheets) to regulate the end face of sheets S, stacked in sheet cassette 59, on the opposite side from the sheet feeding direction. To regulate the side face positions of sheets S, a fixed side face guide 67 and a movable side face guide 69 opposite to the guide 67 are provided on the respective sides of sheet cassettes 59. An air blasting mechanism 71 for blasting the air onto the side faces of the stacked sheets is provided on the same side as the fixed side face guide 67. The air blasting mechanism 71 has a fan or the like, so that the air is blasted onto the side ends of the sheets from an air blow-off port 73 as appropriate.

The air blasting mechanism 71 operates to blast the air onto the side faces of the sheets from the air blow-off port 73 of the air blasting mechanism 71. The sheets are fanned as the air thus blown off lifts up the upper sheets S, to cancel sticking between the sheets. Accordingly, the sheets can reliably be separated one by one to be fed.

In the conventional sheet feeding device using such fanning mechanism with the air, however, it is necessary to provide in advance an air blasting mechanism having a fan, duct and others as described above. For a user who does not need to feed special sheets of paper, the device is provided with an unnecessary mechanism, which would disadvantageously increase the cost and size of the device.

Further, provision of the air blasting mechanism in the device main body increases the space thereof, which goes against downsizing of the image forming apparatus that is eagerly longed for from the standpoint of effective use of space (space saving) by small offices and home offices rapidly increasing in number in these years.

SUMMARY OF THE INVENTION

The present invention is directed to a sheet stacking device, a sheet feeding device incorporating the same, and an image forming apparatus incorporating the same. In one aspect of the present invention, a sheet stacking device includes a sheet stacking case configured to contain sheets and an air supply unit configured to supply air. The sheet stacking case includes a securing mechanism securing the air supply unit, and a duct adapted to send the air supplied from the air supply unit to end portions of the sheets contained in the sheet stacking case.

Further features of the present invention will become apparent from the following description of exemplary embodiments (with reference to the attached drawings).

DESCRIPTION OF THE EMBODIMENTS

Hereinafter, a sheet feeding device and an image forming apparatus using a sheet stacking device according to an embodiment of the present invention will be described with reference to the drawings.

Figure 1:
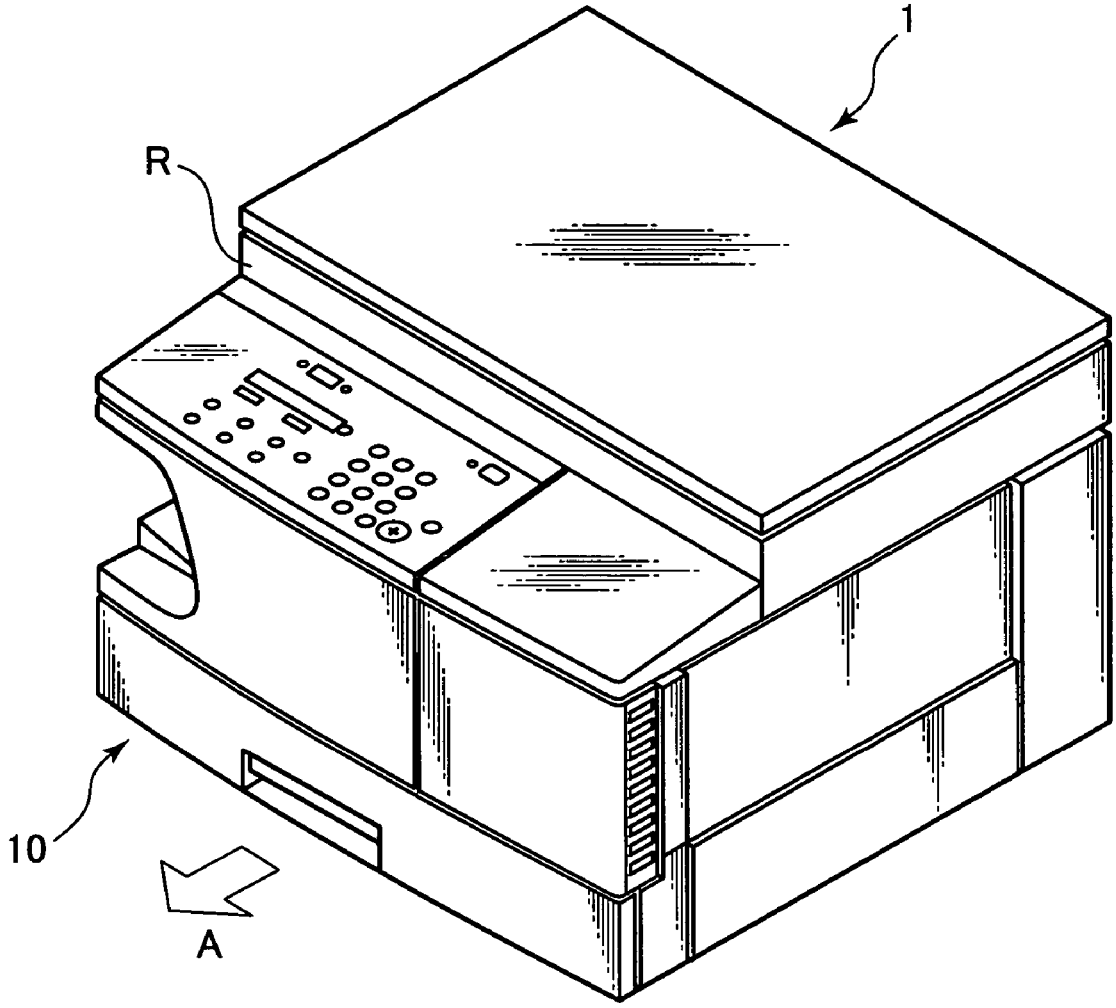
FIG. 1 is a perspective view of an image forming apparatus provided with a sheet stacking device according to an embodiment of the present invention.
Figure 2:
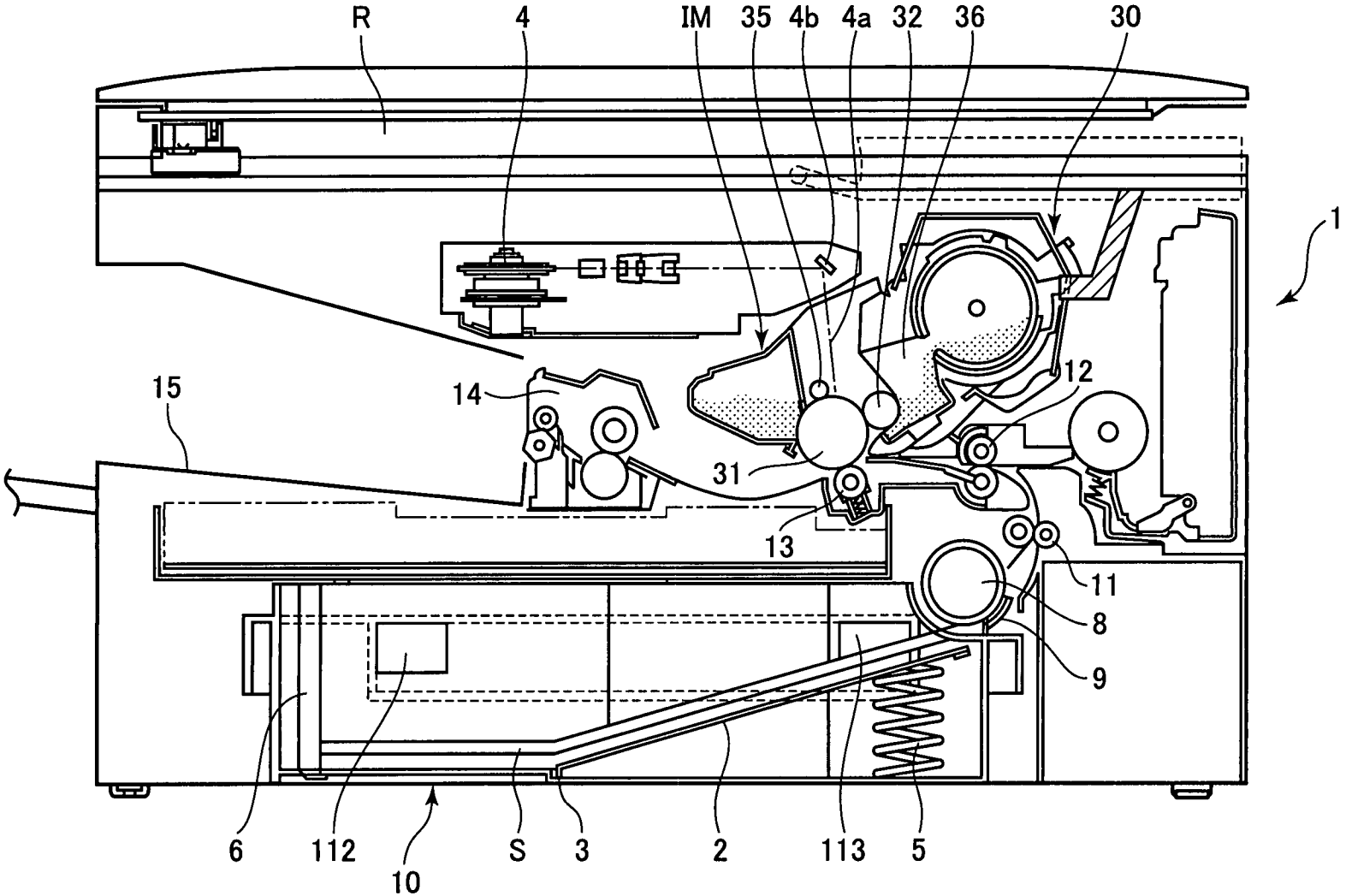
FIG. 2 is a vertical cross sectional view of the image forming apparatus shown in FIG. 1.
Figure 3:
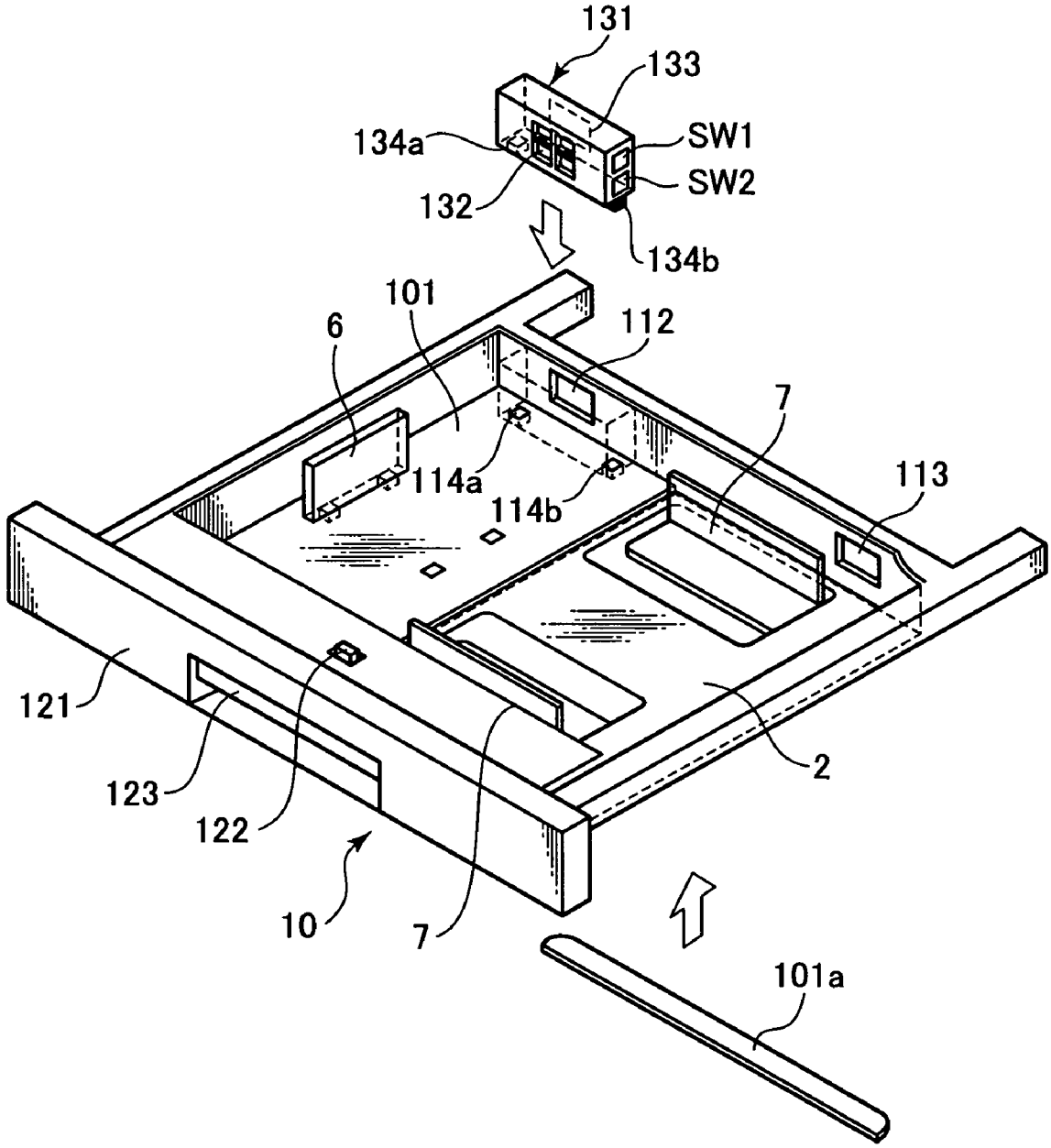
FIG. 3 is a perspective view of a sheet cassette according to the embodiment shown in FIG. 1.
Figure 4A:
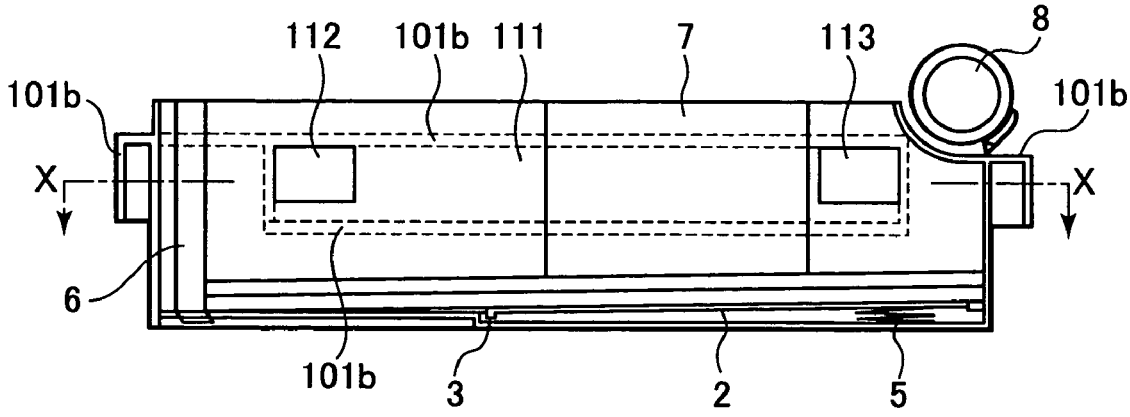
FIGS. 4A and 4B show a cross sectional view and a top plan view of the sheet cassette shown in FIG. 3.
Figure 4B:
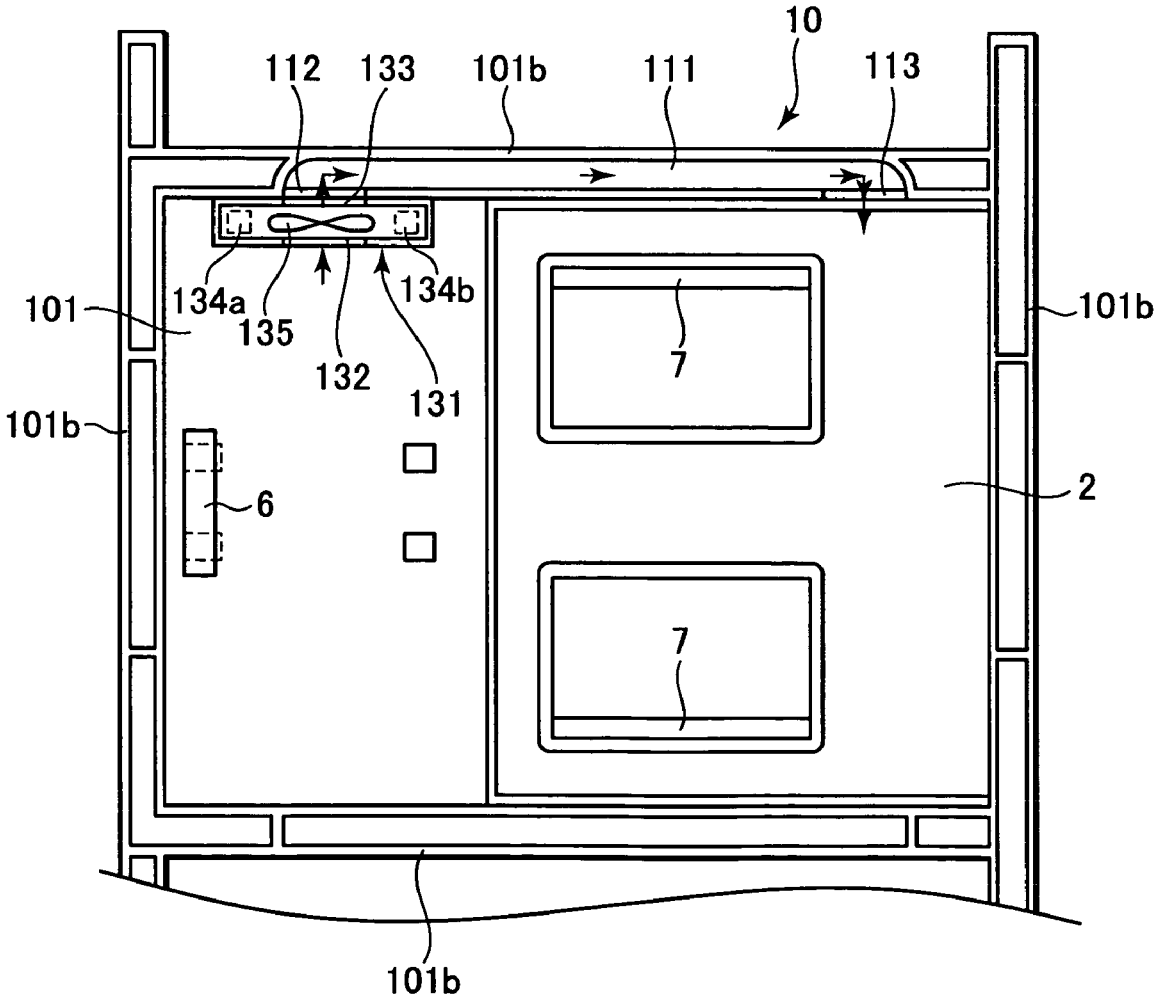

An embodiment of the present invention will now be described with reference to FIGS. 1-4. FIG. 1 is a perspective view of an image forming apparatus, FIG. 2 is a cross sectional view of the image forming apparatus, FIG. 3 is a perspective view of a sheet cassette that is a sheet stacking device, and FIGS. 4A and 4B are vertical and horizontal cross sectional views, respectively, of the sheet cassette.

Firstly, an overall configuration of the image forming apparatus will be described briefly. As shown in FIGS. 1 and 2, a main body 1 of the image forming apparatus includes an original reading portion R that has a platen glass on which an original is placed, an image sensor irradiating the original with light and converting the reflected light to a digital signal, and others. A laser scanner 4 and an image forming portion IM are provided beneath the original reading portion R. The image forming portion IM includes a process cartridge 30, which is integrally provided with a photosensitive drum 31 as an image bearing member, a developing sleeve 32 as a developing unit, and a charge roller 35 as an electrifying unit. The image forming portion also includes a transfer roller 13 and a fixing unit 14. A sheet cassette 10 is provided beneath the image forming portion IM. The sheet cassette 10 is the sheet stacking device having a great number of sheets S of a predetermined size stacked and contained therein.

The sheet cassette 10 constituting the sheet stacking device containing sheets will now be described. As shown in FIGS. 3 and 4, the sheet cassette 10 includes a sheet stacking case 101 and a front cover 121 coupled to sheet stacking case 101. Provided at the bottom of the sheet stacking case 101 are: a sheet stacking plate 2 that can swing upward and downward about a spindle 3 with supporting sheets; and a coil spring 5 that pushes an end of the sheet stacking plate 2 to make a sheet S come into pressure contact with a sheet feed roller 8. Further, a sheet rear end regulating plate 6 regulating the rear end of the supported sheets and sheet side end regulating plates 7 regulating respective side ends of the sheets are provided. The front cover 121 is provided with a hook 122 for alignment of the sheet cassette 10 when it is mounted to the main body of the device, and a handle 123 for use when inserting/removing the sheet cassette 10 to/from the main body of the device.

A reinforcement member 101*b* of a U shape that opens downward is integrally formed on each of the four outer side surfaces of the sheet stacking case 101, for enhancement of strength. A duct bottom plate 101*a* is bonded to the opening of the reinforcement member 101*b* at the side surface on the rear side (opposite to the side surface to which the front cover 121 is attached), to thereby constitute a duct 111. That is, the duct 111 is formed integrally with the sheet stacking case 101 by bonding the duct bottom plate 101*a*.

An opening 112 for taking in the air from an air supply unit 131, which will be described below, to the duct 111, and an opening 113 for blasting the air having passed through the duct 111 onto an end portion of the sheet are formed at the side surface of the sheet stacking case 101 on the rear side. Further, mounting holes 114*a*, 114*b* for mounting the air supply unit 131 are provided on the bottom surface of the sheet stacking case 101.

Hereinafter, a sheet feeding device provided with the sheet cassette 10 will be described. A sheet feed roller 8 and a separating pad 9 coming into pressure contact with the sheet feed roller 8 are arranged at the device main body, to feed sheets S stacked on the sheet stacking plate 2 within the sheet cassette 10 one by one. The sheet S thus separately fed is conveyed by a conveying roller pair 11, provided on the conveying path, to a registration roller pair 12.

Firstly, an operation in the case of feeding ordinary paper in this image forming apparatus will be described.

Initially, while a read original is converted to a digital signal, the sheets S as recording media in the sheet cassette 10 are sent out by the sheet feed roller 8. The sheets are separated one by one at the contact portion between the sheet feed roller 8 and the separating pad 9, and delivered by the conveying roller pair 11 to the registration roller pair 12. At this time, a sheet leading-end sensor arranged downstream of the registration roller pair 12 in the conveying direction detects the leading end of the sheet S having passed the nip of the registration roller pair 12.

Next, the photosensitive drum 31 is irradiated with lasers from the laser scanner 4 at a prescribed timing based on detection of the leading end by the sheet leading-end sensor. The laser light emitted from the laser scanner 4 is reflected by a reflecting mirror 4*b*, to irradiate the outer peripheral surface of the photosensitive drum 31 arranged in the process cartridge 30. At this time, electrostatic latent images are sequentially formed on the outer peripheral surface of the photosensitive drum 31 that is uniformly charged with a primary charge roller 35 within the process cartridge 30 and rotating in a clockwise direction. The electrostatic latent images are developed by a developing unit to obtain visible images. Toner within a developing chamber 36 is delivered via the developing sleeve 32 onto the outer peripheral surface of the photosensitive drum 31, and electrically adsorbed at a portion not irradiated with laser light 4*a*, so that visible toner images are formed on the outer peripheral surface of the photosensitive drum 31.

The sheet S is conveyed to a point between the photosensitive drum 31 and the transfer roller 13 by the rotating registration roller pair 12, and the visible toner images formed on the outer peripheral surface of the photosensitive drum 31 are sequentially transferred onto the sheet surface.

The sheet S having the visible toner image transferred thereon is delivered to the fixing unit 14 along a conveying guide arranged approximately parallel to the nip line formed by the photosensitive drum 31 and the transfer roller 13, and then stacked on a discharge sheet stacking tray 15.

The air supply unit 131 for supplying the air will now be described. The air supply unit 131 can have a box-shaped frame body, in which an air blow-off hole 133, a fan 135, and an air in-take hole group 132 are provided. The air supply unit 131 is further provided with a detachable storage battery (not shown) which supplies electric power to the drive fan 135. The air supply unit 131 further includes a switch SW1 to turn on/off the rotation of the fan 135, and a switch SW2 capable of changing the number of rotations of the fan 135 in a stepwise manner.

Next, a procedure in the case of feeding special sheets in this image forming apparatus will be described.

Initially, when the handle 123 of the front cover 121 is grabbed (pulled frontward), the hook 122 turns downward about the center of rotation (not shown), so that the positional regulation with the device main body 1 is released. A sheet stacking plate press-down member (not shown) working with the hook 122 presses the sheet stacking plate 2 downward, and a sheet stacking plate holding member (not shown) comes in engagement with the sheet stacking plate 2 to secure the sheet stacking plate 2 at its lowest position (see FIG. 4A).

With the handle 123 grabbed, the sheet cassette 10 is pulled in an arrow A direction off the device main body 1. The air supply unit 131 is then attached to the sheet stacking case 101 (see FIG. 3).

Nails 134*a*, 134*b* are provided at the bottom surface of the air supply unit 131, which are inserted to the mounting holes 114*a*, 114*b* of the sheet stacking case 101 to secure the air supply unit 131 to the sheet stacking case 101. In the state in which the air supply unit 131 is secured, the air blow-off hole 133, the fan 135, and the air in-take hole group 132 come to face the opening 112 of the sheet stacking case 101 in this order. With the switch SW1 turned off, the number of rotations of the fan 135 suitable for the type of the special sheets stacked on the sheet stacking case 101 is selected, and the sheet cassette 10 is inserted to the device main body in the direction opposite to the arrow A direction. When the sheet cassette 10 is inserted to the device main body, the engagement of the unillustrated stacking plate holding member with the sheet stacking plate 2 is released, and the top sheet of the special sheets stacked on the sheet stacking plate 2 comes into pressure contact with the sheet feed roller 8 by the coil spring 5. Further, in conjunction with the release of the engagement between the stacking plate holding member and the sheet stacking plate 2, a link mechanism (not shown) turns the switch SW1 on to activate the fan 135. As the fan 135 rotates at the prescribed number of rotations, the air passes through the air in-take hole group 132, the fan 135, the opening 112, the duct 111, and the opening 113 in this order (arrows in FIG. 4B), and is blasted onto the side face of the sheet stack. The upper sheets S blasted with the air prior to feeding of the sheets are readily separable as the sticking between the sheets is cancelled.

Subsequently, the sheet is fed in the same manner as in the feeding operation of the ordinary paper described above, for image formation.

In the present embodiment, a reinforcement member 101*b* formed on the side surface of sheet stacking case 101 is used as a part of the duct 111, which produces the effects of simplification of the configuration and others. The duct may be provided integrally with the sheet stacking case, or a duct as a separate piece may be connected by bonding or the like.

Another example of the sheet cassette that is the sheet stacking device will now be described with reference to FIGS. 5-8. The overall configuration of the image forming apparatus is identical to that of the embodiment described above. Of the sheet cassette of the present example, the same configurations as those described above are denoted with the same reference characters, and description thereof will not be repeated.

Figure 5:
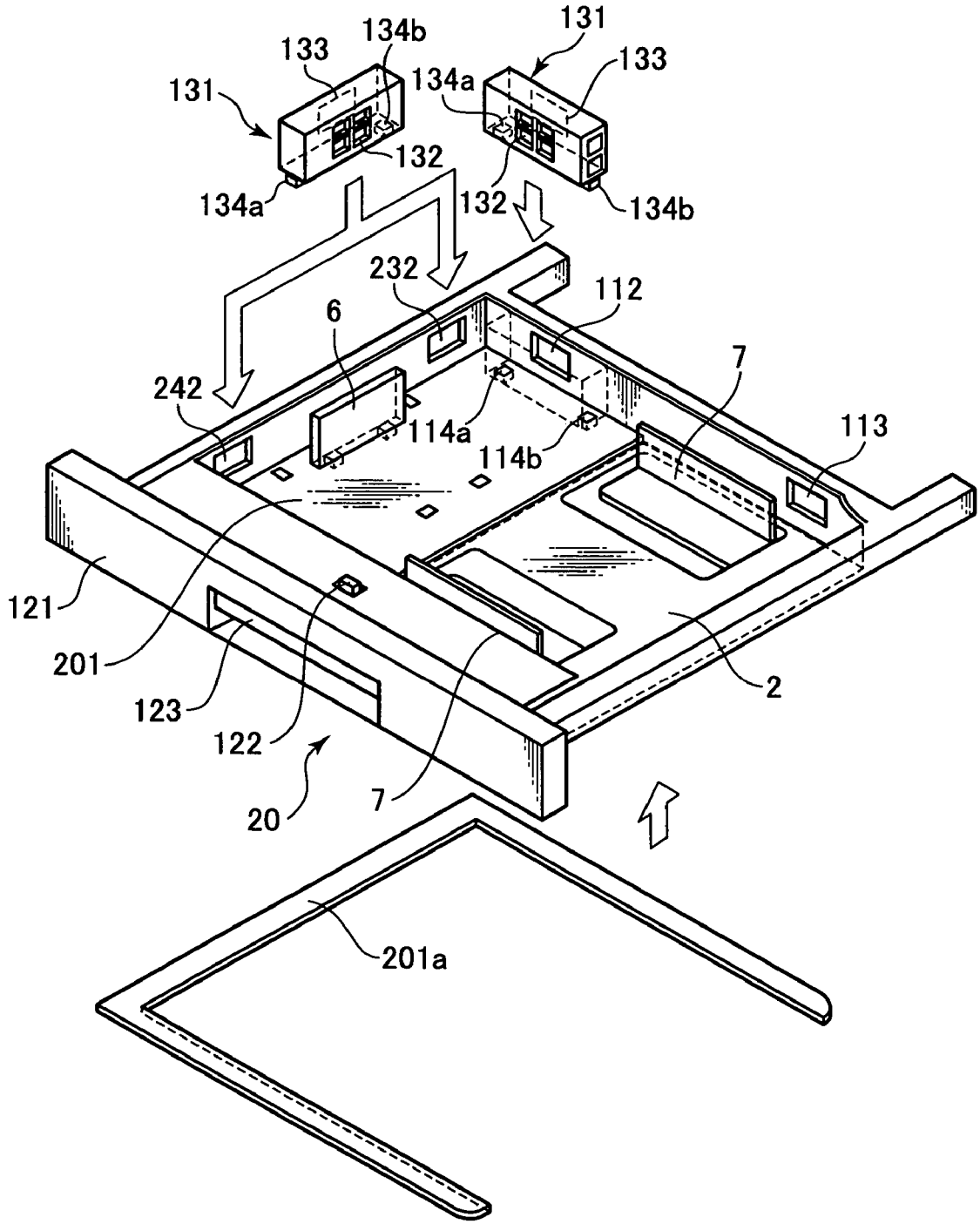
FIG. 5 is a perspective view of another example of the sheet cassette.
Figure 6:
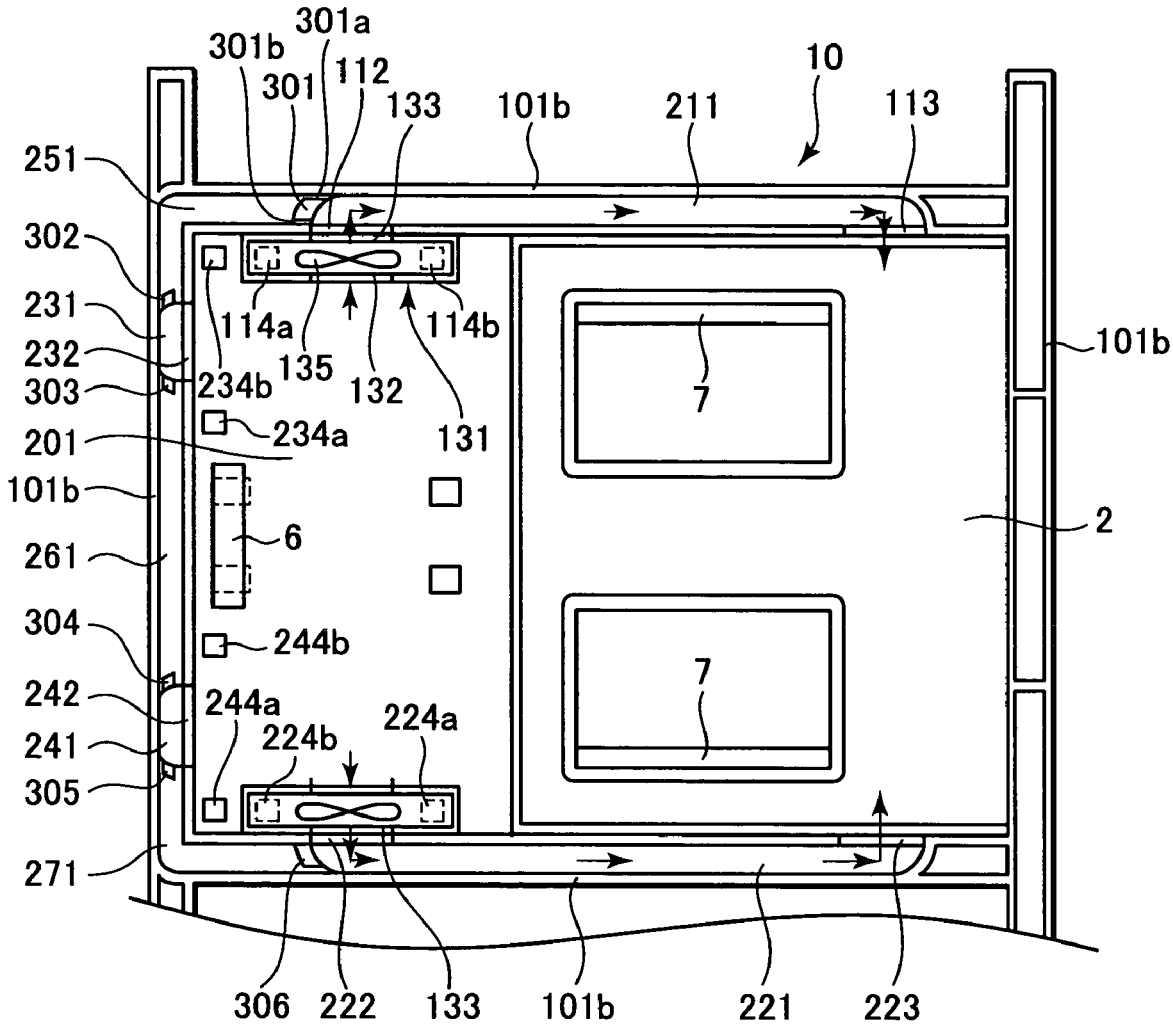
FIGS. 6-8 are top plan views of the sheet cassette shown in FIG. 5.
Figure 7:
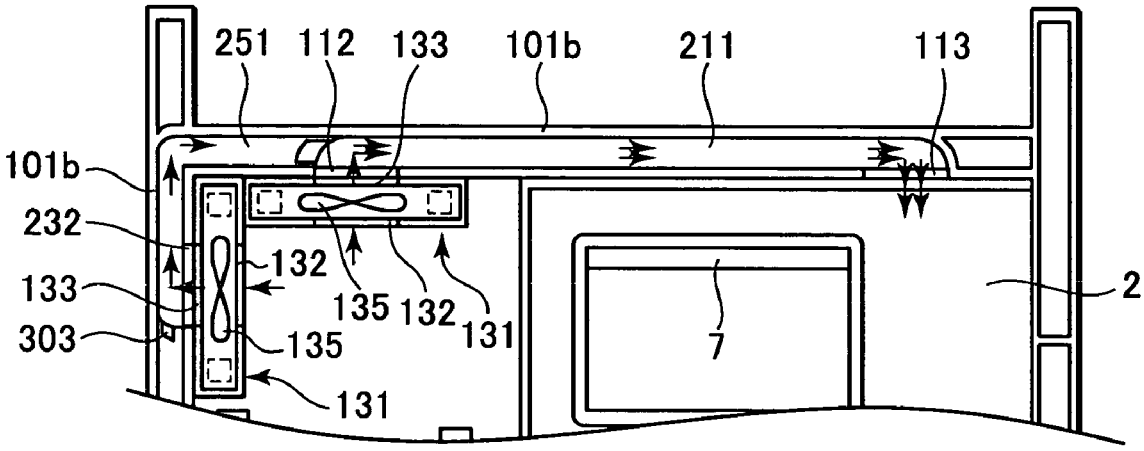
Figure 8:
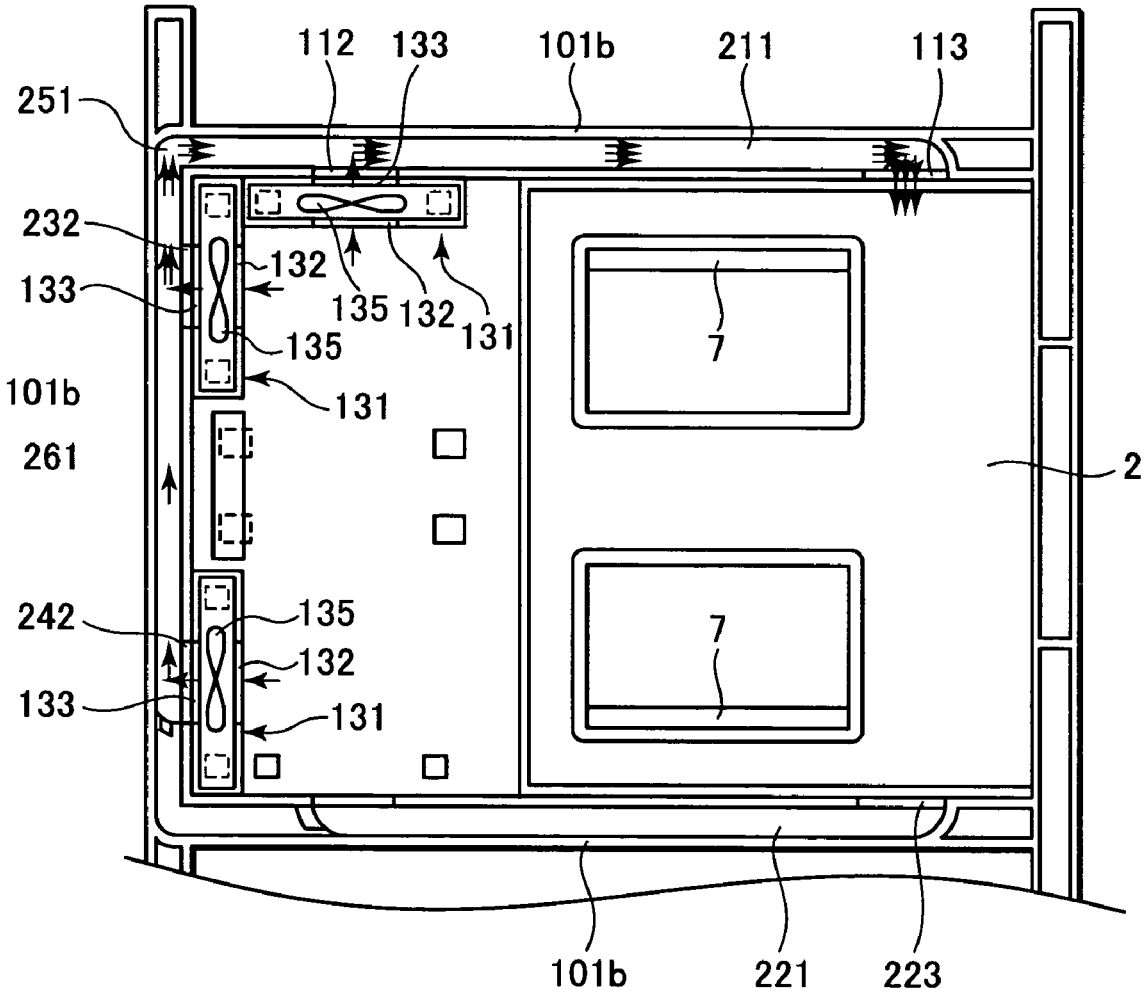
Figure 9:
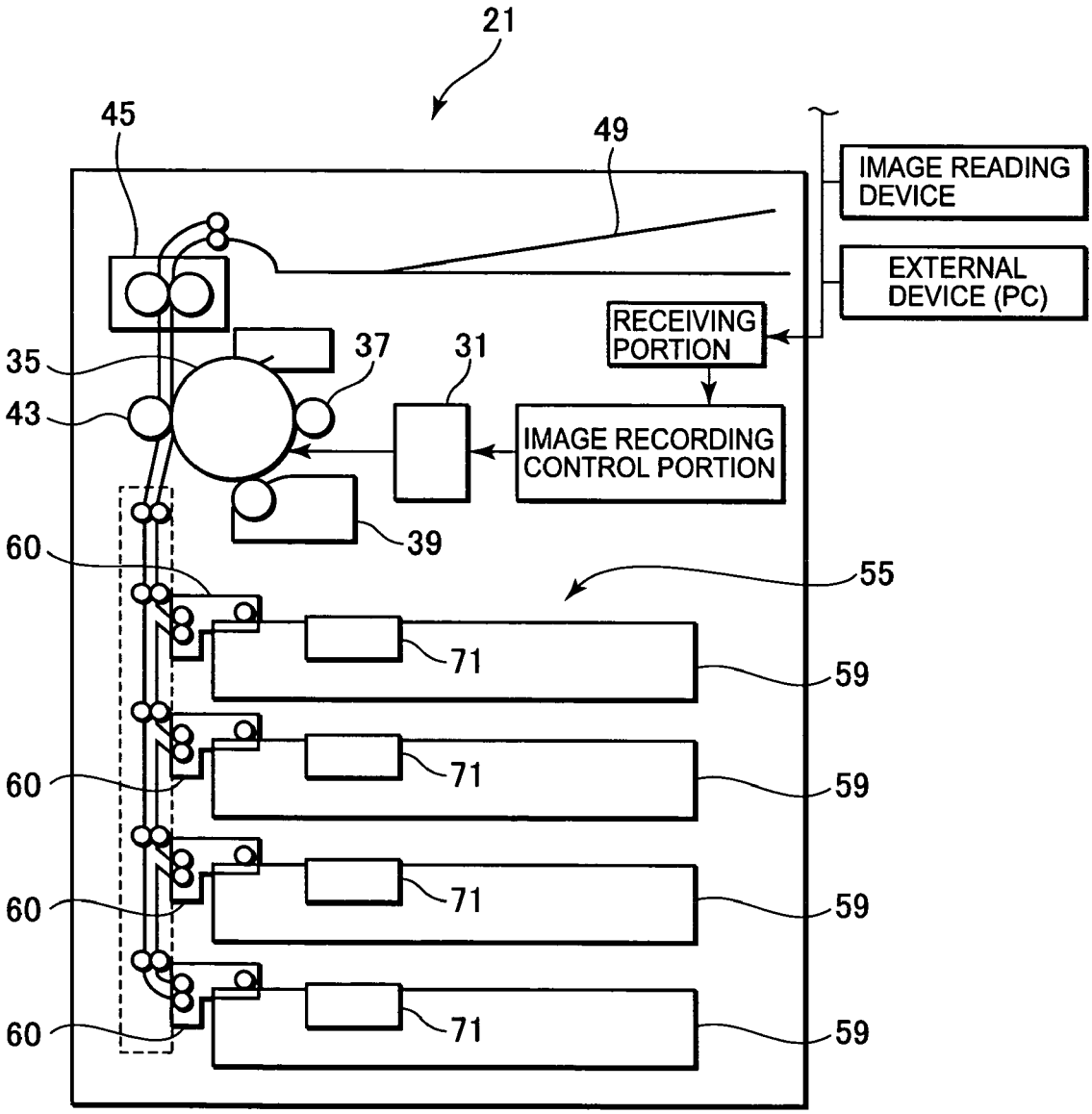
FIG. 9 PRIOR ART
FIG. 9 is a vertical cross sectional view of an image forming apparatus provided with a conventional sheet feeding device.
Figure 10:
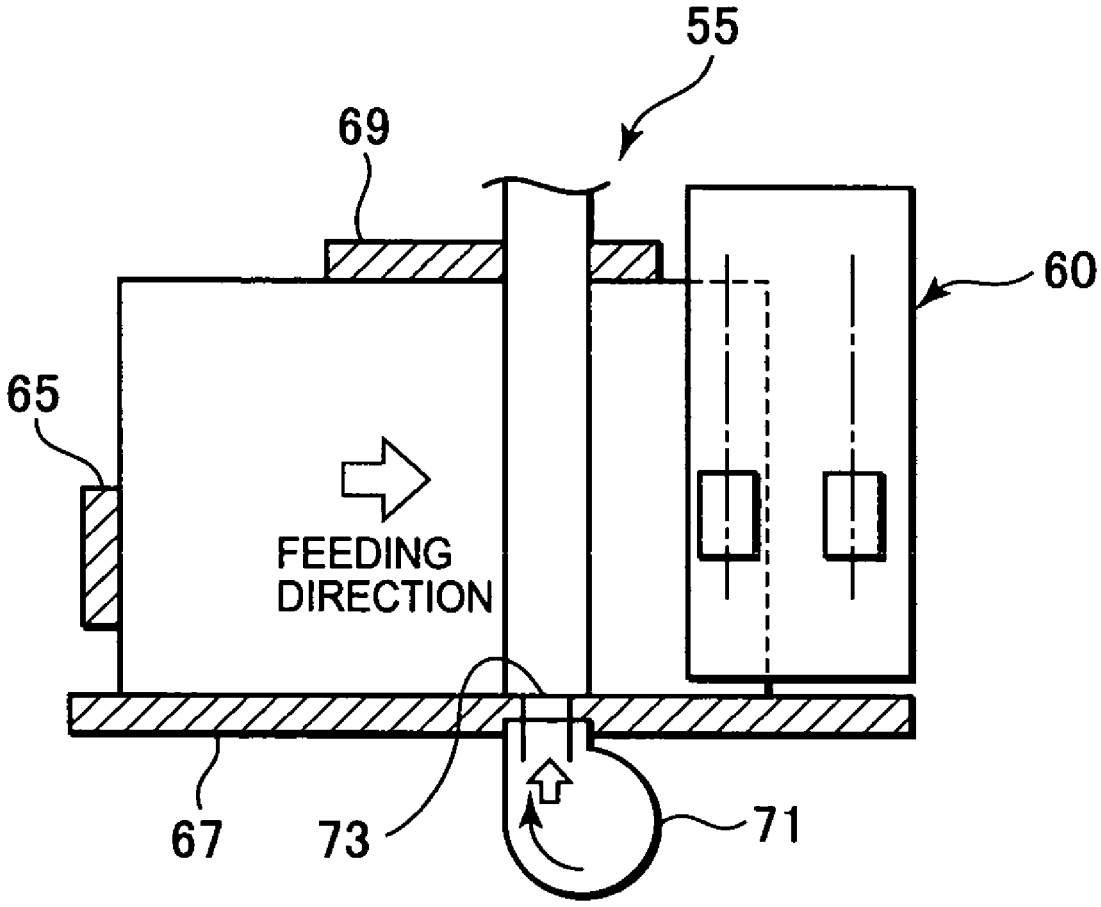
FIG. 10 PRIOR ART
FIG. 10 is a top plan view of the sheet feeding device shown in FIG. 9.

FIG. 5 is a perspective view of the sheet cassette, and FIGS. 6-8 are horizontal cross sectional views of the sheet cassette, showing different mounting states of the air supply unit(s) 131.

The sheet cassette 20 includes a sheet stacking case 201 and a front cover 121 coupled to the sheet stacking case 201. The sheet stacking case 201 has ducts 211, 221, 251, 261, and 271 which are formed by fixing a duct bottom plate 201*a* by screws (not shown) or the like to the underside of the reinforcement members formed on the side surfaces (having the same structure as the reinforcement members 101*b* provided at the above-described sheet stacking case 101). Partitions 301, 302, 303, 304, 305 and 306 separate the ducts. The partitions 301-306 have slits (of which those for partition 301 are denoted by 301*a*, 301*b*), which are formed to facilitate removal of the respective partitions. This enables selective use of the desired duct(s).

The ducts 211, 221 are respectively provided with openings 112, 222 for taking in the air, and openings 113, 223 for blowing off the air passed through the ducts. At the bottom surface of the sheet stacking case 201, pairs of holes 114*a*, 114*b*, 224*a*, 224*b*, 234*a*, 234*b*, and 244*a*, 244*b* for mounting air supply units 131 are provided. These mounting holes allow air the supply units 131 to be attached to four positions.

Further, spaces 231 and 241 are formed between the ducts 251 and 261 and between the ducts 261 and 271, respectively. The sheet stacking case 201 has openings 232 and 242 for blowing the air from the air supply units 131 into the spaces 231 and 241, respectively.

The operation in the case of feeding ordinary paper in this image forming apparatus is the same as described above, and thus, description thereof will not be repeated. Hereinafter, the manner of attaching the air supply unit(s) 131 will be described for respective patterns.

Firstly, the case of using the ducts 211 and 221 will be described with reference to FIG. 6. The ducts 211 and 221 can be used by leaving all the partitions unremoved. Two air supply units 131, 131 are secured to the sheet stacking case 201 by inserting nails 134*a*, 134*b* of the respective air supply units 131 to the mounting holes 114*a*, 114*b* and 224*a*, 224*b* of the sheet stacking case 201. The air supply unit 131 has the same structure as described above.

With this configuration, the air passes through the air in-take hole groups 132, the fans 135, the openings 112, 222, the ducts 111, 221, and the openings 113, 223 in this order, and is blasted onto the side face of the sheet stack. This cancels sticking between the upper sheets S to facilitate separation thereof, and the sheet is fed by the sheet feed roller 8. Next, FIG. 7 shows a configuration in the case where the air of greater volume than in the case of FIG. 6 is required. In this case, the partitions 301 and 302 are removed to allow the duct 251 to communicate with the duct 211. Two air supply units 131 are secured to the mounting holes 114*a*, 114*b* and 234*a*, 234*b* of the sheet stacking case 201.

As such, the air passes through the air in-take hole groups 132, the fans 135, the openings 112, 232, the ducts 251, 211 and the opening 113 in this order, and is blasted onto the side face of the sheet stack. The upper sheets S become readily separable as the sticking between the sheets is cancelled, and fed by the sheet feed roller 8. Since the air from the two air supply units 131 can be supplied via the single opening 113, the air of greater volume than in the configuration of FIG. 6 can be obtained.

Although FIG. 7 illustrates only the side of the duct 211, the duct 221 on the opposite side may be made to communicate with the duct 271 by removing the partitions 305 and 306, so that two air supply units 131 are used to blast the air from the opening 223.

Next, FIG. 8 shows the case where the partitions 301, 302, 303 and 304 are removed to cause the ducts 211, 251 and 261 to communicate with each other. Three air supply units 131 are secured to the mounting holes 114*a*, 114*b*, 234*a*, 234*b* and 244*a*, 244*b* of the sheet stacking case 201.

With this configuration, the air passes through the air in-take hole groups 132, the fans 135, the openings 112, 232, 242, the ducts 261, 251, 211 and the opening 113 in this order, and is blasted onto the side face of the sheet stack. This cancels sticking between the upper sheets S to facilitate separation thereof, and the sheets are sent out by the sheet feed roller 8. Since the air can be supplied from three air supply units 131, the air of greater volume than in the configuration of FIG. 7 can be blasted onto the sheets. It is noted that this configuration allows supply of the air from only one side of the sheets.

That the air supply units 131 can be attached in various patterns as shown in FIGS. 5-8 means that not only the number of rotations of the fan(s) but also the number of fans can be changed, so that the air can be set to an optimal volume to address a variety of types of paper.

Specifically, the volume of air supplied from the opening 113 in the respective configurations in FIGS. 6-8 holds the following relation: that in FIG. 6<that in FIG. 7<that in FIG. 8. Accordingly, it is possible to select such that the air of an optimal volume for the type of special sheets stacked on the sheet stacking case 201 can be blown off from the opening 113.

Although the separating pad system has been shown as an example of the sheet separating unit in the present embodiment, it may be a nail separating system, a retard system, or an air feeding system.

Further, although the case of using the storage battery provided in the air supply unit 131 as the driving unit of the fan 135 in the air supply unit 131 has been shown by way of example in the embodiment, the present invention is not limited thereto. The fan 135 may be supplied with electric power by connecting the power source provided in the device main body to the fan 135 via a wire.

Still further, although the case of setting the number of rotations of the fan in advance by the switch SW2 has been described in the embodiment, the present invention is not limited thereto. A radio transmitter may be provided at the device main body and a radio receiver may be provided at the air supply unit 131, and a control unit of the device main body may transmit a radio signal by the radio transmitter to cause the fan 135 in the air supply unit 131 to rotate at the desired number of rotations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-191537, filed Jun. 30, 2005, which is hereby incorporated by reference herein in its entirety.

What is claimed is:

1. A sheet stacking device comprising:

a sheet stacking case configured to contain sheets; and an air supply unit attachable to an end portion of the sheet stacking case and configured to supply air, wherein the sheet stacking case includes a securing mechanism securing the air supply unit to an inside of the sheet stacking case and a duct adapted to send the air supplied from the air supply unit to end portions of the sheets contained in the sheet stacking case, and the duct is formed integrally with an outside surface of the sheet stacking case, and wherein an opening through which an air supplied by the air supply unit is passed and an opening through which an air sent by the duct is blown to the end portions of the sheets are formed on the side surface of the sheet stacking case.

2. The sheet stacking device according to claim 1, wherein the sheet stacking case includes a plurality of the ducts.

3. The sheet stacking device according to claim 2, wherein the sheet stacking case includes a plurality of the securing mechanisms corresponding to the plurality of ducts.

4. The sheet stacking device according to claim 2, wherein the sheet stacking case includes a removable partition separating the plurality of ducts from each other, and the ducts may be made to communicate with each other by removing the partition.

5. The sheet stacking device according to claim 1, wherein the duct is provided on a side surface of the sheet stacking case, and the securing mechanism is provided inside the sheet stacking case.

6. The sheet stacking device according to claim 1, wherein the air supply unit includes a fan and a storage battery driving the fan.

7. A sheet feeding device comprising:

a sheet stacking device including a sheet stacking case configured to contain sheets; and a sheet feeding mechanism operable to feed the sheets from the sheet stacking device, wherein the sheet stacking case includes an air supply unit attachable to an end portion of the sheet stacking case and configured to supply air, a securing mechanism securing the air supply unit to an inside of the sheet stacking case and a duct adapted to send the air supplied from the air supply unit to end portions of the sheets contained in the sheet stacking case, and the duct is formed integrally with an outside surface of the sheet stacking case, and wherein an opening through which an air supplied by the air supply unit is passed and an opening through which an air sent by the duct is blown to the end portions of the sheets are formed on the side surface of the sheet stacking case.

8. An image forming apparatus comprising:

a sheet stacking device including a sheet stacking case configured to contain sheets;

a sheet feeding mechanism operable to feed the sheets from the sheet stacking device; and an image forming portion operable to form an image on the sheets fed by the sheet feeding mechanism, wherein the sheet stacking case includes an air supply unit attachable to an end portion of the sheet stacking case and configured to supply air, a securing mechanism securing the air supply unit to the an inside of sheet stacking case and a duct adapted to send the air supplied from the air supply unit to end portions of the sheets contained in the sheet stacking case, and the duct is formed integrally with an outside of the sheet stacking case, and wherein an opening through which an air supplied by the air supply unit is passed and an opening through which an air sent by the duct is blown to the end portions of the sheets are formed on the side surface of the sheet stacking case.

* * * * *